United States Patent [19]

Lillibridge

[11] 4,283,003

[45] Aug. 11, 1981

[54] RECLOSABLE ENVELOPE

[75] Inventor: Harold R. Lillibridge, San Mateo, Calif.

[73] Assignee: Champion International Corporation, Stamford, Conn.

[21] Appl. No.: 105,210

[22] Filed: Dec. 19, 1979

Related U.S. Application Data

[63] Continuation of Ser. No. 16,308, Feb. 28, 1979, Pat. No. 4,234,122.

[51] Int. Cl.[3] ..... B65D 27/28

[52] U.S. Cl. ..... 229/77; 229/46

[58] Field of Search ..... 229/77, 78 A, 78 B, 229/46

[56] References Cited

U.S. PATENT DOCUMENTS

| | | | |
|---|---|---|---|
| 1,294,324 | 2/1919 | Vierengel | 229/78 A |
| 1,336,629 | 4/1920 | Kimbark | 229/78 A |
| 1,358,234 | 11/1920 | Novick | 229/78 A |
| 1,369,659 | 2/1921 | Holbrook | 229/78 A |
| 2,072,125 | 3/1937 | Novick | 229/78 A |

FOREIGN PATENT DOCUMENTS

| | | | |
|---|---|---|---|
| 1913 | of 1913 | United Kingdom | 229/63 |

*Primary Examiner*—Stephen P. Garbe

*Attorney, Agent, or Firm*—Evelyn M. Sommer

[57] ABSTRACT

An envelope having a first tab adhered to the flap and a second tab adhered to the main body portion with means for releasably interconnecting the tabs. In one embodiment the second tab includes three elongated fingers, each integral with the tab and cut therefrom on three sides. An elongated member extends from the first tab and is releasably received under each finger. In another embodiment, the second tab includes one elongated finger integral with the tab and cut therefrom on two sides, and the first and second tabs have the same configuration which allows them to be cut from a piece of material without significant waste.

2 Claims, 6 Drawing Figures

RECLOSABLE ENVELOPE

This is a continuation of application Ser. No. 016,308 Filed Feb. 28, 1979, now U.S. Pat. No. 4,234,122.

The present invention relates to a reclosable envelope, and more particularly relates to such a reclosable envelope as is used in inter-office communications. A first tab is adhered to the main portion of the envelope and a second adhered to the overlying flap, with there being elongated means for releasably interconnecting these two tabs.

Conventionally inter-office envelopes are designed to be of sturdy construction in order to withstand multiple reuses thereof as the envelope is employed for the shipment of inter-office communications within a large organization. Typically, an envelope of this prior art type is formed of relatively high-grade paper, and includes a reclosable flap mechanism, usually consisting of a string secured to a tab affixed to the flap of the envelope and capable of being wound about a second tab fixed to one surface of the body of the envelope. However, this prior art type of envelope requires riveting of each tab to their respective parts of the envelope. This results in a time consuming and expensive manufacturing process, which includes many manual steps.

Applicant is also aware of a prior art device disclosed in U.S. Pat. application Ser. No. 808,601 filed on June 21, 1977, by Robert Cohn et al, entitled Improved Inter-Office Envelope. This application specifically discloses the advantageous concept of connecting various tabs to an envelope via hot melt adhesive. This eliminates the requirement of riveting of such tabs and allows the tabs to be secured to the envelope by means of high-speed machines. In that application each of the tabs is substantially annular in one embodiment and are secured to their respective parts of the envelope by a single spot of adhesive. In another embodiment, the tab securable to the main body portion of the envelope is circular and is secured to the envelope by means of a plurality of spots of hot melt adhesive.

The present invention is an improvement over that disclosed in the above-identified application insofar as it presents additional unique configurations to the various tabs utilized in coupling the flap and main body portion of such an envelope. Specifically, in the application identified above, the adhesive is not coextensive with the main support portion of the tab, due to the construction of the annular and circular tabs, thus there is only a minimum amount of adhesion power to couple the tab to the envelope. In addition, since the tabs are circular or annular, there is waste of materials present when the tabs are cut from a single piece of material. In addition, the string interconnecting the two tabs in the above-identified application is merely wrapped around the bottom tab so as to couple the two tabs.

Accordingly, it is an object of the present invention to provide an improvement over the prior art and to provide a sturdy, efficient and relatively inexpensive inter-office envelope which may be manufactured at minimum cost and reused because of its reclosable flap.

Another object of the present invention is to provide such a reclosable envelope where the various tabs are very strongly adhered to the envelope by means of adhesive substantially coextensive with the bottom surface of each tab.

Another object is to provide a reclosable envelope in which the materials used to form the tabs are of such a shape that cutting them from the same piece of material results in a minimum of waste.

Another object of the present invention is to provide a reclosable envelope in which the elongated member, such as a string, used to releasably interconnect two tabs is strongly and firmly connectable to the tabs.

The foregoing objects are basically attained by providing a reclosable envelope comprising an enclosed body portion hingedly connected to an overlying flap; a first tab rigidly connected to the outer surface of the flap by an adhesive; a second tab rigidly connected to the outer surface of the body portion by an adhesive; and means for releasably interconnecting the first and second tabs to thereby releasably secure the overlying flap and the body portion, the second tab comprising a support portion having at least one elongated finger, the elongated finger having a base and at least two opposed sides, the bottom surface of the elongated finger being free of adhesive, the base being integral with the support portion and the opposed sides being separated from and laterally bounded by the support portion, the means including an elongated flexible member releasably receivable between the bottom surface of the elongated finger and the top surface of the body portion.

More specifically, in one embodiment of the invention, the tab located on the envelope main body portion is substantially rectangular and has adhesive substantially coextensive with the bottom surface thereof to securely couple the tab to the body portion of the envelope. Three elongated fingers are partially cut from the center of the tab and releasably receive the elongated member from the tab located on the flap. Thus, the tab is very securely attached to the envelope and the elongated member is very securely receivable in the space between the fingers and the body portion of the envelope. Because the tab is substantially rectangular, there is little waste when a plurality of these tabs are cut from a single piece of material.

In another embodiment, the tabs located both on the flap and the main body portion of the envelope are of the same and complementary configuration so that they can be cut from a single piece of material without significant waste. Each includes two straight sides, a side having two substantially triangular extensions or fingers and a fourth side having three substantially triangular extensions or fingers. All but one of the fingers is adhered by adhesive to the flap or main body portion so that significant adhesion results.

Other objects, advantages and salient features of the present invention will become apparent from the following detailed description, which, taken in conjunction with the annexed drawings, discloses preferred embodiments of the present invention.

Referring now to the drawings which form a part of this original disclosure and which are not necessarily to scale:

Figure 1:
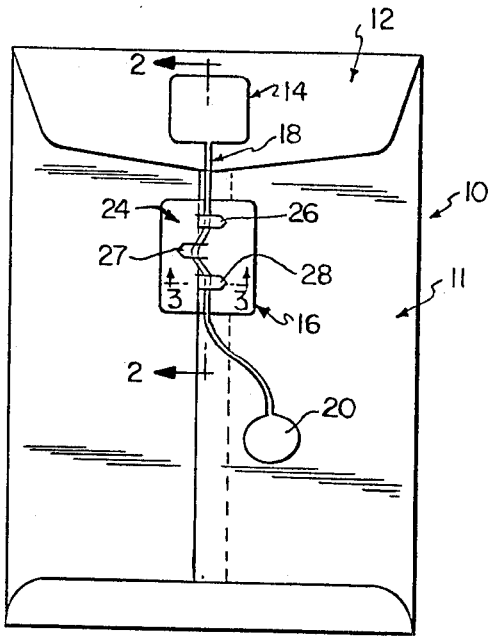
FIG. 1 is a top plan view of a reclosable envelope in accordance with the present invention showing a tab coupled to the main body portion of an envelope having a plurality of elongated fingers therein which releasable receive an elongated member extending from a tab coupled to the overlying flap on the envelope.
Figure 2:
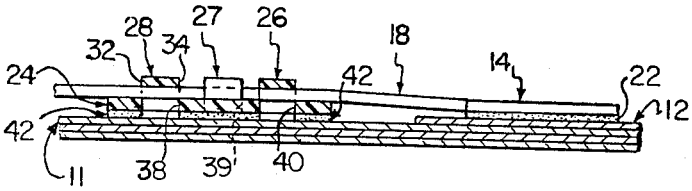
FIG. 2 is an enlarged fragmentary sectional view in side elevation taken along lines 2—2 in FIG. 1, showing how the plurality of fingers on the tabs releasably receive the elongated member.
Figure 3:
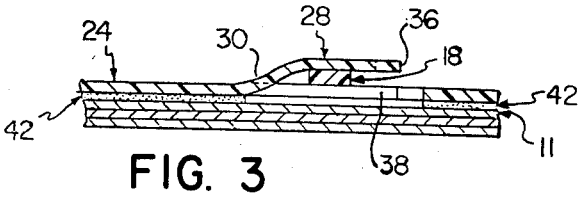
FIG. 3 is an enlarged fragmentary sectional view in front elevation taken along line 3—3 in FIG. 1 showing in more detail the relationship of one of the elongated fingers and the elongated member.

Referring now the drawings in further detail, a first embodiment of the present invention is shown in FIGS. 1, 2 and 3 and comprises an envelope 10 including an enclosed body portion 11 hingedly connected to an overlying flap 12, a first tab 14 and a second tab 16. Releasably interconnecting the first and second tabs is an elongated flexible member 18.

Envelope 10 is a conventional envelope formed of paper or other suitable material including reinforced polymeric material. The overlying flap 12 is preferably integrally formed with the enclosed body portion 11 of the envelope. The basic purpose of the invention is to provide an apparatus for releasably securing the flap 12 to the main body portion 11.

The first tab 14 is preferably formed of a polymeric material having an elastic memory and is rectangular in plan and has a substantially rectangular cross section. As shown in FIG. 1, the elongated member 18 is integral with and extends from the bottom of the first tab. The elongated member 18 has a substantially rectangular cross section as shown in FIGS. 2 and 3. At the distal end of the elongated member 18 is an enlarged end portion 20 which facilitates manual manipulation of the elongated member.

As shown in FIG. 2, the first tab 14 is rigidly secured to overlying flap 12 by a layer of adhesive 22, which is preferably a hot melt adhesive and which is preferably in contact with the entire bottom surface of the first tab.

The second tab 16 is also formed of polymeric material and has an elastic memory. As shown in FIGS. 1, 2 and 3, the tab is rectangular in plan and has a substantially rectangular cross section. The second tab 16 comprises a support portion 24 and three elongated fingers 26, 27 and 28 partially cut from the center of the support portion about a portion of their peripheries. Each of the elongated fingers has a base, designated 30 for finger 28 shown in FIG. 3, which is integral with the support portion, two opposed parallel sides, designated 32 and 34 for finger 28 in FIG. 2, and a distal end, which is designated 36 for finger 28 shown in FIG. 3. The distal ends shown for the three fingers in FIG. 1 are pointed and are formed by the intersection of two acute cuts along the end of the finger. Finger 27 faces to the left as seen in FIG. 1, while fingers 26 and 28 faced to the right.

Basically, each of the fingers 26, 27 and 28 are formed by cutting or incising the support portion 24 completely through its thickness except in the area of each finger's base. In this area the fingers are each integrally formed with the support portion and can be pivoted about the base by an upward force exerted on the distal end of each finger. Because the material has an elastic memory, displacement of each finger upwardly as shown in FIGS. 2 and 3 provides a downward bias towards the body portion 11 of envelope 10.

Since each of the fingers 26, 27 and 28 are formed by incising the support portion 24 around the outline of each finger except for the base, the opposed sides for each finger are separated from and laterally bounded by the support portion 24. This incising defines an aperture receiving each finger in the support portion, which aperture is exposed when each finger is raised upwards. These apertures are designated in FIG. 2 as 38 for finger 28, 39 for finger 27 and 40 for finger 26.

Preferably, the entire bottom surface of the second tab 16, except that portion below the bottom surface of each of the fingers 26, 27 and 28, is in contact with an adhesive 42, which is preferably a layer of hot melt adhesive, that adheres the tab 16 to body portion 11.

Because each of the tabs is adhered to the envelope 10 by means of adhesive, the manufacture of each envelope can be provided by high-speed machines, thereby reducing the cost for each envelope produced. Since the adhesive contacts the bottom surface of each of the tabs almost entirely, each tab is very securely adhered to the envelope.

In use, once the material to be transmitted in the envelope 10 is placed inside the hollow body portion 11, the overlying flap 12 is folded over into a position shown in FIG. 1. Then the elongated member 18, which is preferably flexible, is maneuvered into a releasably receiving relationship with the fingers 26, 27 and 28. This is accomplished by slightly raising the fingers and weaving the elongated member 18 underneath the raised fingers in a fashion shown in FIGS. 1, 2 and 3. The longitudinal axis of each finger is substantially perpendicular to the longitudinal axis of member 18. In this situation the elongated member is received between the bottom surface of each elongated finger and the top surface of the body portion 11 of the envelope 10. Each finger biases downwardly onto the elongated member thereby forcing the member against support portion 24, securely receiving the elongated member and securely closing the envelope. In this orientation, as shown in FIGS. 2 and 3, each finger has a portion which is slightly raised above the top plane of the support portion 24 of the second tab 16. The amount of such deflection may be exaggerated in the drawings and depends upon the thickness and resiliency of elongated member 18, fingers 26–28, and support portion 24.

Figure 4:
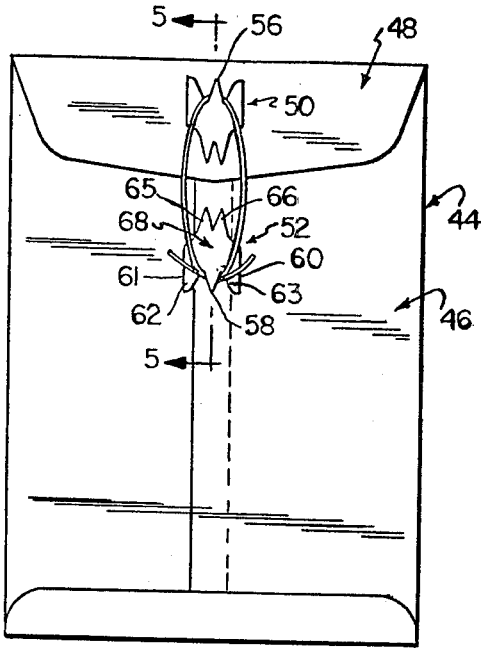
FIG. 4 is a top plan view of another embodiment of the reclosable envelope of the present invention showing two tabs of similar outline configuration with a releasably receivable elongated member interconnecting the two tabs.
Figure 5:
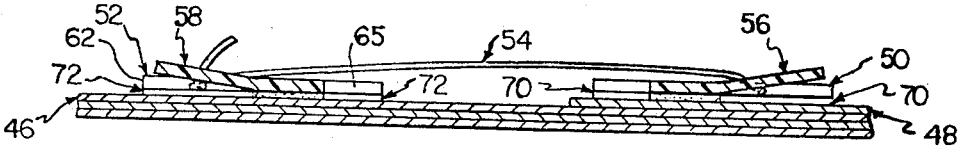
FIG. 5 is an enlarged fragmentary sectional view in side elevation taken along line 5—5 in FIG. 4 showing the releasable receiving of the elongated fingers with regards to the elongated member used therein.

Turning now to FIGS. 4 and 5, a second embodiment of the present invention is shown therein including an envelope 44 having an enclosed body portion 46, an overlying flap 48 hingedly connected to the body portion, a first tab 50, a second tab 52 and an interconnecting means in the form of an elongated member 54.

The outline configuration of each of tabs 50 and 52 is the same; however, as oriented on envelope 44 they are in the opposite direction. Each is formed from a polymeric material preferably having an elastic memory. Each tab is substantially rectangular in cross section and is adhered to envelope 44 by adhesive, preferably a layer of hot melt adhesive, extending completely across the bottom surface of each tab, except in the area below elongated finger 56 on tab 50 and elongated finger 58 on tab 52.

Since both tabs are similar in configuration, only one will be described in detail. Thus, the second tab 52 has two parallel, linear sides 60 and 61, with the end of the second tab facing away from flap 48 including the elongated finger 58 and two additional fingers 63 and 64 adjacent to the elongated finger 58. As seen in FIG. 4, the elongated finger 58 is substantially triangular, with its base being integral with tab 52 and its two opposed sides being separated from and laterally bounded by the additional fingers 62 and 63 which are integral with the tab. On the end of the second tab 52 facing towards flap 48 are two further fingers 65 and 66 which are substantially triangular in configuration and are integral with the tab 52. Tab 52 is formed by cutting its shape from a single piece of material and all of the area of the tab but for elongated finger 58 is a support portion 68 for that finger.

Figure 6:
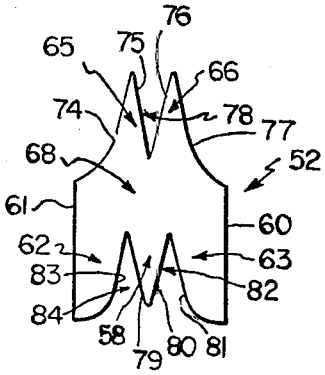
FIG. 6 is an enlarged plan view of the bottom tab shown in FIG. 4.

Referring to FIG. 6, tab 52 is shown in enlarged form. At the top the two further fingers 64 and 66 are shown as being substantially iscoseles triangular extensions projecting from tab 52 with straight sides 74 and 75 defining finger 65, the acute angle between sides 74 and 75 being about 30°. Side 74 extends downwardly and curves outwardly to intersect with tab side 61. Similarly, straight sides 76 and 77 define finger 66, the acute angle therebetween being about 30°. Side 75 extends downwardly and curves outwardly to intersect with tab side 60. Sides 75 and 76 intersect at an angle of about 30° to form a triangular slot 78 in the top edge of tab 52. The depth of slot 78 is such that at its lowermost point (seen in FIG. 6 as the intersection of sides 75 and 76) a plane, perpendicular to the face of the tab 52 and receiving the intersection of sides 61 and 74 and 60 and 77, is slightly below such lowermost point.

At the bottom of tab 52, projecting elongated finger 58 is defined by straight opposed sides 79 and 80 which are at an acute angle of about 30° and are preferably of equal length so that finger 58 is in the form of an iscoseles triangle. Projecting finger 63 is defined by tab side 60 and side 81, which intersects side 80 and side 60. Side 81 is straight for most of its length but then curves outwardly to intersect with side 60. Sides 80 and 81 intersect at an angle of about 30° to define a triangular slot 82 in the bottom edge of tab 52. Projecting finger 62 is defined by tab side 61 and side 83, which intersects side 79 and side 61. Side 83 is straight for most of its length but then curves outwardly to intersect with side 61. Sides 79 and 83 intersect at an angle of about 30° to define a triangular slot 84 in the bottom edge of tab 52.

As is evident, fingers 65 and 66 have a shape complementary to the shape of slots 82 and 84, and finger 58 has a shape complementary to the shape of slot 78.

As clearly seen in FIG. 4, tabs 50 and 52 can be cut from the same piece of material without significant waste since the top end of tab 50 shown in FIG. 4 is complementary to and correspondingly interlocks with the top end of tab 52. Thus, a plurality of these tabs can be quickly and easily stamped or otherwise incised from a long strip of material, with little or no waste.

As shown in FIG. 5, a layer of adhesive 70 is interposed between the bottom surface of tab 50 and the top of flap 48, except for that area below elongated finger 56 so that finger 56 can be manipulated upwardly away from the flap 48. Similarly, a layer of adhesive 72 is interposed between the entire bottom surface of tab 52 and the top of envelope body portion 46 except in the area below elongated finger 58. The additional fingers 62 and 63 extend downwardly as shown in FIG. 4 substantially the same distance as elongated finger 58 to provide a strong support for tab 52 against a force tending to pull the elongated finger 58 upwardly. This is the same in tab 50 with regard to elongated finger 56.

As shown in FIGS. 4 and 5, the elongated member 54 is a string, which can be formed from cloth or other suitable materials such as rubber or polymers. While the elongated member 54 is shown not being permanently attached to either of the tabs, it can be if desired.

As shown in FIGS. 4 and 5, once the tabs are adhered to the envelope 44 and the material to be transmitted in the envelope is received in the enclosed body portion 46, flap 48 is folded over onto the body portion 46 and the elongated member 54 is manipulated so that a portion extends under elongated finger 56 on tab 50 and the two ends of the elongated member are manipulated underneath the elongated finger 58 on tab 52. This is clearly shown in FIG. 5 in which a portion of each of the elongated fingers 56 and 58 is somewhat raised above the plane of the top of each tab and the elongated member 54 is biased downwards towards the body portion 46 and the flap 48. In this position, the elongated member 54 is very securely, although releasably, received by each tab and the flap 48 is secured against the body portion 46. It should be noted that the drawings are not necessarily to scale and, depending on the thickness and resiliency of envelope 44, member 54 and tabs 50 and 52, the amount of displacement of fingers 56 and 58 may vary.

While advantageous embodiments have been chosen to illustrate the invention, it will be understood by those skilled in the art that various changes and modifications can be made therein without departing from the scope of the invention as defined in the appended claims.

What is claimed is:

1. A reusable, reclosable envelope comprising:

an enclosed body portion hingedly connected to an overlying flap;

a first tab rigidly connected to the outer surface of said flap by an adhesive;

a second tab rigidly connected to the outer surface of said body portion by an adhesive; and means for releasably interconnecting said first and second tabs to thereby releasably secure said overlying flap and said body portion, said means including an elongated, flexible member;

said first and second tabs being identical in shape but facing in opposite directions, each tab, also, being complementary in shape to the other by having a first portion adapted to be nestably received and interlocked within a second portion whereby the tabs may be formed in tandem from a single sheet of material each tab including a support portion having two outer elongated fingers and an inner elongated finger spaced about one edge thereof, with the support portion of said second tab facing away from said flap, each of said elongated fingers having a base and at least two opposed sides, the bottom surface of said inner elongated finger being free of adhesive, with the outer elongated fingers extending at least as far as the inner elongated finger to provide support for said second tab and, said bases being integral with said support portion, whereby said flexible member is capable of being releasably received between the bottom surface of said inner elongated finger and the top surface of said body portion.

2. An envelope according to claim 1, wherein said inner elongated finger is substantially triangular in shape.

* * * * *